US007506870B2

(12) United States Patent
Park

(10) Patent No.: US 7,506,870 B2
(45) Date of Patent: Mar. 24, 2009

(54) DRIVE NIP RELEASE APPARATUS

(75) Inventor: Daniel Clark Park, West Linn, OR (US)

(73) Assignee: Xerox Corporation, Norwalk, CT (US)

( * ) Notice: Subject to any disclaimer, the term of this patent is extended or adjusted under 35 U.S.C. 154(b) by 550 days.

(21) Appl. No.: 11/187,747

(22) Filed: Jul. 22, 2005

(65) Prior Publication Data

US 2007/0018385 A1 Jan. 25, 2007

(51) Int. Cl.
*B65H 5/06* (2006.01)

(52) U.S. Cl. ..... 271/274

(58) Field of Classification Search ..... 271/273, 271/274, 314, 275

See application file for complete search history.

(56) References Cited

U.S. PATENT DOCUMENTS 4,438,917 A 3/1984 Janssen et al.
4,971,304 A 11/1990 Lofthus
5,169,140 A 12/1992 Wenthe, Jr.
5,278,624 A 1/1994 Kamprath et al.
5,678,159 A 10/1997 Williams et al.
6,585,368 B1 7/2003 Park
6,834,854 B2 * 12/2004 Inoue et al. ..... 271/242
2003/0085505 A1 * 5/2003 Inoue et al. ..... 271/10.01

* cited by examiner

*Primary Examiner*—Patrick H Mackey
*Assistant Examiner*—Gerald W McClain
(74) *Attorney, Agent, or Firm*—Gibb I.P. Law Firm, LLC

(57) ABSTRACT

In embodiments herein one or more cams are operatively connected to corresponding ones of idler rollers within nip drive assemblies. As the cams rotate, the cams move the idler rollers between a first position biased against the drive rollers and a second position out of contact with the drive rollers. A camshaft is operatively connected to the cams, and the camshaft is operatively connected to a clutch driven by the drive motor/axle of the nip drive assembly. One feature of embodiments herein is that the camshaft (and consequently the cams themselves) is rotated by the clutch only when the drive axle rotates in a reverse direction opposite the forward direction. Thus, the forward movement of the drive axle moves media through the drive nips and reverse movement of the drive axle rotates the cams, thereby controlling the position of the idler rollers.

17 Claims, 5 Drawing Sheets

DRIVE NIP RELEASE APPARATUS

BACKGROUND

Generally, media path drive roller nips have been released (i.e. opened in order to disengage) using an electrical solenoid or dedicated motor in order to activate the nip release mechanism. One actuator is required to drive the nip itself (i.e. motor) while another actuator is required to drive the nip release mechanism (i.e. motor or solenoid).

SUMMARY

Embodiments herein comprise a printing apparatus (e.g., electrostatographic and/or xerographic machine and/or process), a module installable in a printing apparatus, etc., that have one or more media drive nips. The drive nips each comprise a pair of opposing rollers biased against one another. The rollers comprise drive rollers and corresponding idler rollers opposite the drive rollers. The drive roller is driven by a motor and the idler roller is biased against the drive roller and freely rotates with the drive roller to cause a piece of media (paper, transparencies, cardstock, etc.) to be moved through the drive nip. A drive axle is operatively connected to the drive rollers. The drive axle rotates in a forward direction when moving media through the media drive nip.

In addition, one or more cams are operatively connected to corresponding ones of the idler rollers by way of movable supports. The movable supports transfer movement of the cams to the idler rollers. As the cams rotate, the cams move the idler rollers between a first position biased against the drive rollers and a second position out of contact with the drive rollers. In one embodiment, the cams are shaped and positioned to move pairs of the idler rollers differently as the cams rotate to accommodate different media widths. Thus, for example, in embodiments herein one set of cams could cause only the outer pair of idler rollers to be biased against their corresponding drive rollers for wide media, while another set of cams could cause just an inner pair of idler rollers to be biased against their corresponding drive rollers to accommodate a narrower piece of media. In addition, drive nips can be individually engaged to align the media.

A clutch (single-direction device) is operatively connected to the drive axle. In embodiments herein a camshaft is operatively connected to the cams, and the camshaft is operatively connected to the clutch (for example by gears and/or belts connecting the clutch to the camshaft). One feature of embodiments herein is that the camshaft (and consequently the cams themselves) is rotated by the clutch only when the drive axle rotates in a reverse direction opposite the forward direction. Thus, the forward movement of the drive axle moves media through the drive nips and reverse movement of the drive axle rotates the cams, thereby controlling the position of the idler rollers. Therefore, with embodiments herein, the movement of the cams (and the associated release of the drive nip) can be easily controlled by simple reverse movement of the drive axle and drive motor, as opposed to having to include a separate drive motor for the camshaft or individual actuators or other similar devices for each of the idler rollers.

Thus, for applications that only drive the nip in a single forward direction, the nip release mechanism may be driven using the reverse motion of the nip drive. This strategy allows the drive nip idler(s) to be changed from the released state to the engaged state (or vice versa) any time the nip drive would otherwise be inactive (no media present in nip). A one-way roller clutch or a swing arm apparatus is utilized in order drive the nip release mechanism during nip drive motor reverse operation. During forward drive motor operation, the roller clutch or swing arm prevents the nip release mechanism from being driven, such that normal nip drive is achieved without disturbing the state of the nip release mechanism.

These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

One feature of embodiments herein is that the camshaft (and consequently the cams themselves) is rotated by operation of a one-way clutch (single-direction device) only when the drive axle rotates in a reverse direction opposite the usual forward direction for moving media through the nip. Thus, the forward movement of the drive axle moves media through the drive nip and reverse movement of the drive axle rotates the cam, thereby controlling the position of the idler roller. Therefore, with embodiments herein, the movement of the cam (and the associated release or engagement of the drive nip) can be easily controlled by simple reverse movement of the drive axle, as opposed to having to include a separate drive motor for the camshaft or individual actuators or other similar devices for the idler rollers.

Figure 1:
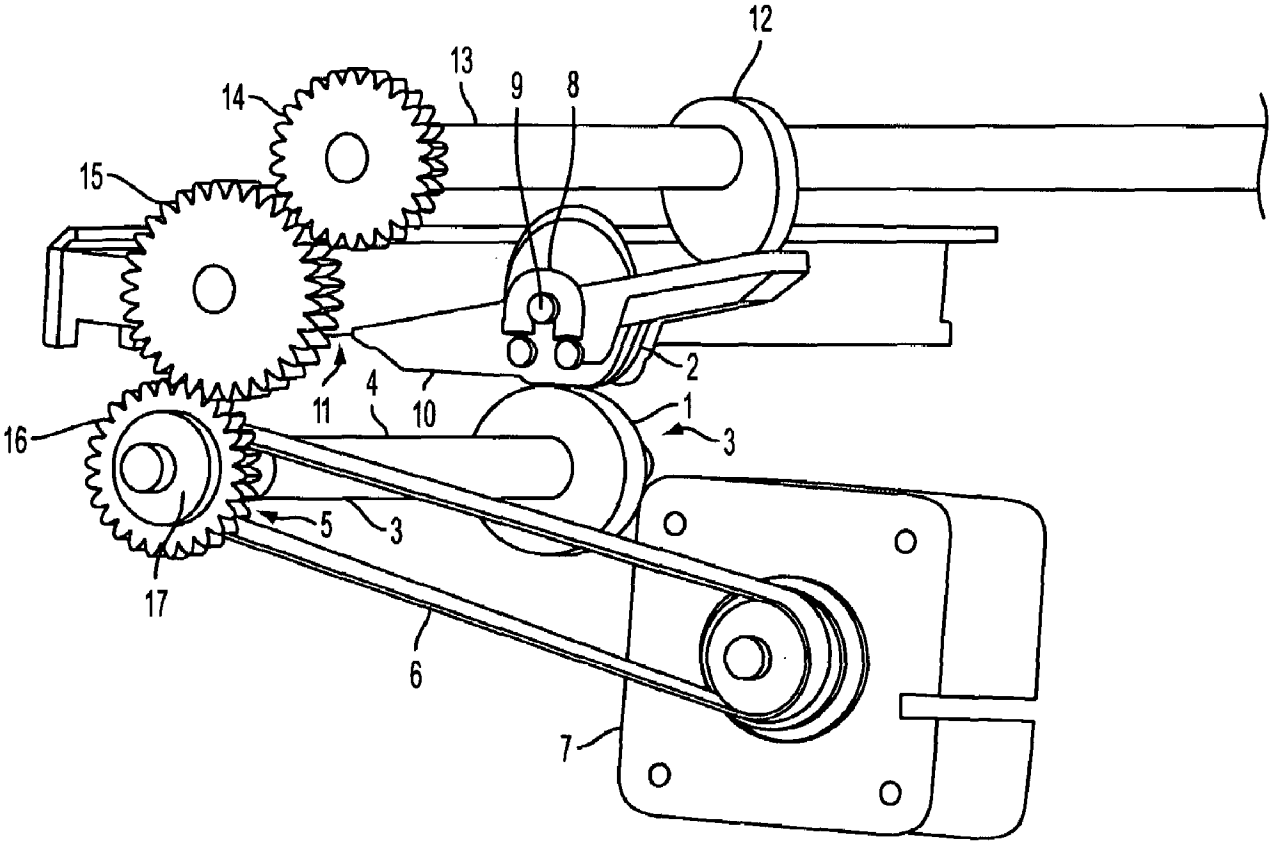
FIG. 1 is a schematic representation of a drive nip assembly according to embodiments herein.

More specifically, as shown in FIG. 1, a media drive nip is formed by a drive roller 1 and an idler roller 2. The drive roller 1 is driven as a part of the drive roller assembly 3, which also includes a shaft or drive axle 4 and a drive pulley 5. The drive roller assembly 3 is driven by a timing belt 6, which in turn is driven by a motor assembly 7 with attached pulley. Alternatively, the drive roller assembly 3 could be driven by a geartrain or could be directly attached to the drive motor.

When the nip is in the engaged (loaded) state (FIG. 1), the idler roller 2 is biased against the drive roller 1 by load springs 8. The load springs bear against the idler shaft 9, which in turn bears against the idler roller 2. The load springs 8 attach to the idler sled or movable support 10. The idler shaft 9 is constrained by a slot in the idler sled 10, but the slot does not prevent the load springs 8 from applying the proper nip load to the idler roller 2. The idler sled 10 is held in place on one end by the idler sled pivot 11, which is fixed. The idler sled is held down on the other end by the nip load cam 12. Note that the cam 12 is rotated down to the loaded position.

Figure 2:
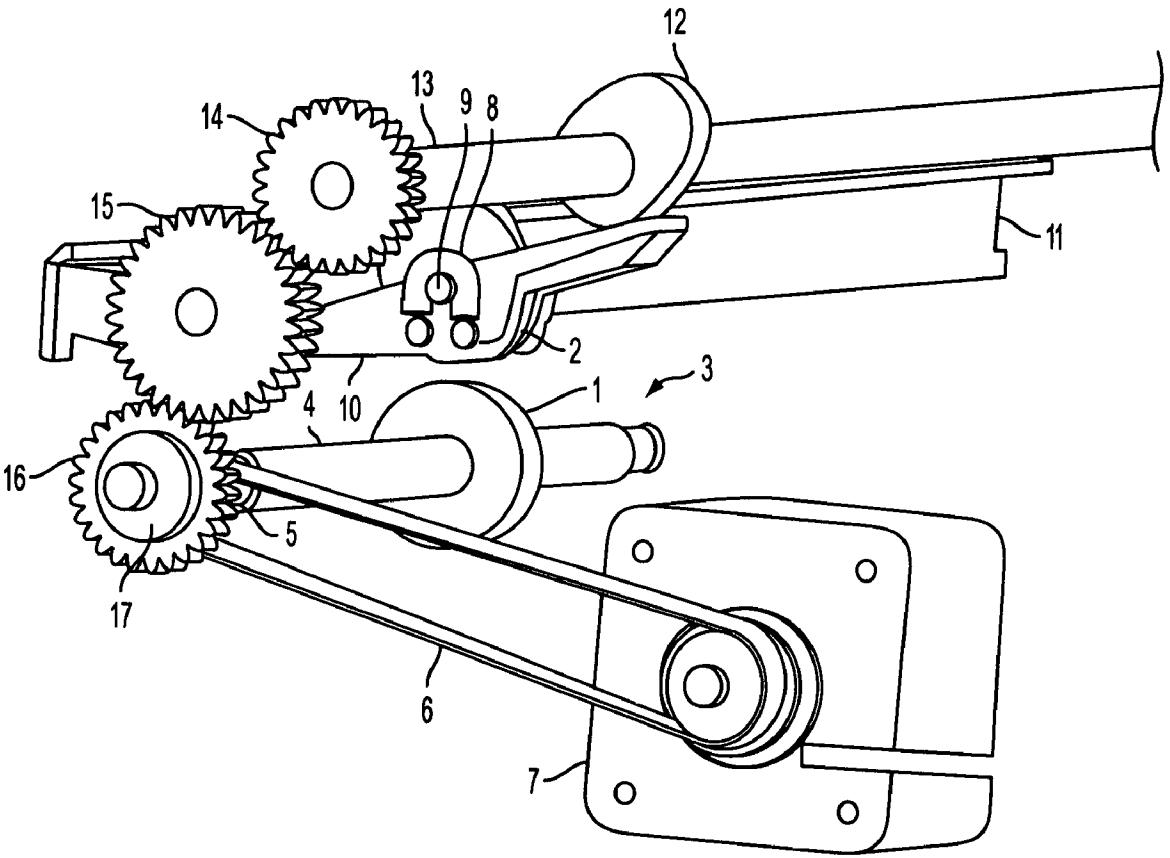
FIG. 2 is a schematic representation of a drive nip assembly according to embodiments herein.

When the nip is in the released (unloaded) state (FIG. 2), the idler roller 2 is suspended above the drive roller 1 by the idler sled 10. The idler shaft 9 rests in the bottom of the slot in the idler sled 10. The idler sled 10 is pulled up against the nip load cam 12 by a return spring (not shown). Note the cam 12 is rotated up to the unloaded position. The embodiments herein may be easily implemented with alternate methods of nip loading. For instance, the nip idler roller 2 could be loaded or unloaded using a rotating linkage.

In this embodiment, the nip load cam 12 is rotated on the nip load camshaft 13, which is driven by gears 14-16. In this embodiment, gear 16 is fastened to a roller clutch (single-direction device) 17; however, the clutch 17 could be incorporated into any of the gears 14-16 to achieve the same effect. By including the clutch 17 within the gear 16 that is adjacent the drive axle 4 (as shown in FIG. 1), the gears 14-16 only rotate when the drive axle 4 rotates in the reverse direction, which reduces wear of the gears 14-16. The roller clutch 17 is oriented such that forward rotation of the drive roller 1 (in the media drive direction) does not act on gear 16, but rather acts as a roller bearing. Reverse rotation of the driver roller will lock the roller clutch 17 such that the gear 16 is driven in order to select a different cam 12 position.

The clutch 17 is a one-way clutch (single-direction device) that can, for example, include internal ratchets that engage in only one direction. Terms such as clutch, one-way device, and single-direction device, used herein can comprise any form of device that only engages in one direction and does not engage in the opposite direction. Such one-way devices are well-known to those ordinarily skilled in the art, and all such devices are intended to be included within the term "clutch," "one-way device," and "single-direction device" as used herein. The clutch 17 connects the gear 16 to the drive axle 4. Therefore, gear 16 only rotates when the drive axle 4 rotates in the reverse direction because when the drive axle 4 rotates in the forward direction, the clutch 17 spins freely and does not cause the gear 16 to rotate. Because of this, gear 16 will only rotate in the reverse direction and will only rotate when the drive axle 4 rotates in the reverse direction.

Figure 4:
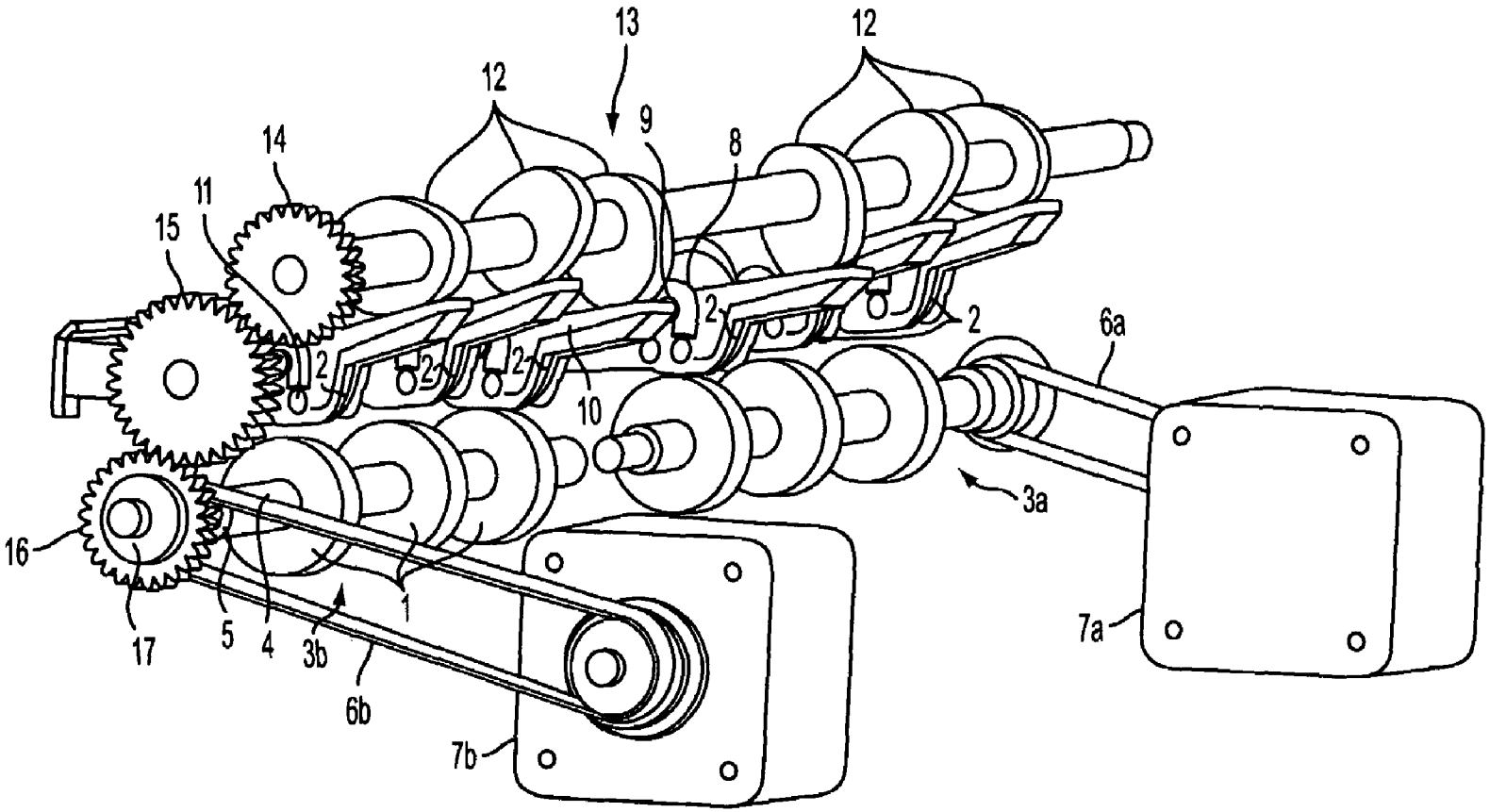
FIG. 4 is a schematic representation of a drive nip assembly according to embodiments herein.
Figure 5:
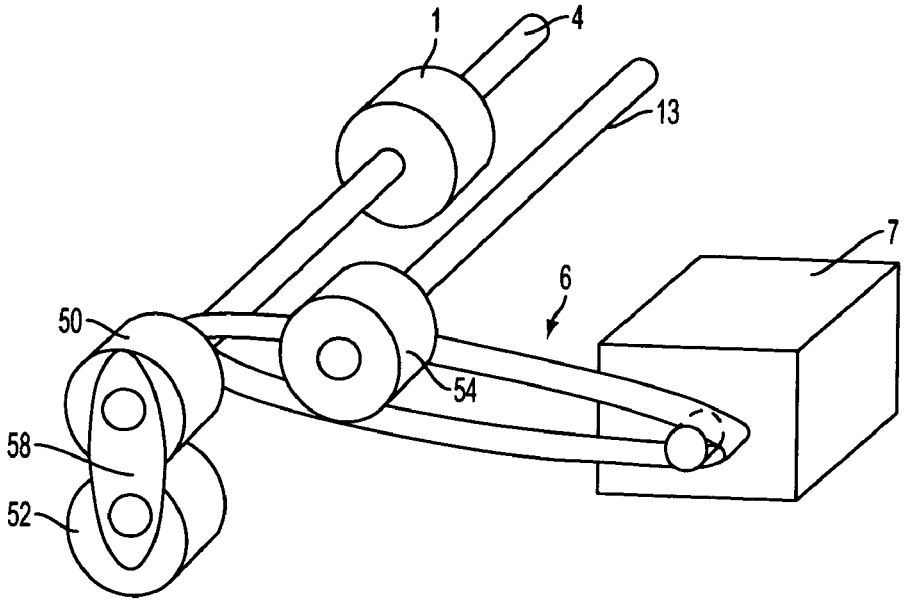
FIG. 5 is a schematic representation of a swing arm embodiment drive nip assembly according to embodiments herein.
Figure 6:
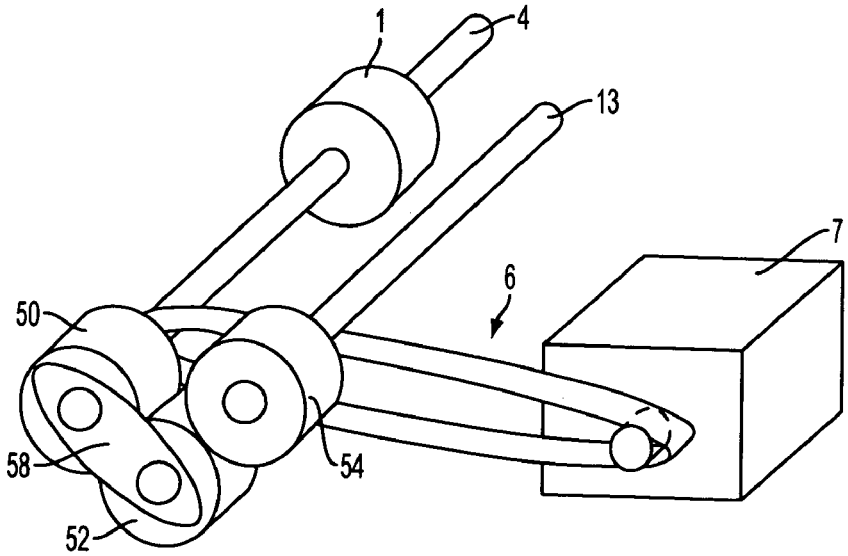
FIG. 6 is a schematic representation of a swing arm embodiment drive nip assembly according to embodiments herein.

Different one-way and single-direction devices may be used to only drive the camshaft 13 when the drive roller 1 is driven in reverse, such as the swing arm mechanism illustrated in FIGS. 5 and 6. More specifically, the apparatus shown in FIGS. 5 and 6 is substantially similar to the structures shown in FIG. 1-4, except for the swing arm connections 50-58. The swing arm connections include gears/rollers 50, 52, and 54, and connecting plate 58. In the forward direction, shown in FIG. 5, the belt 6 drives the drive roller 1 forward. However, if the belt 6 is driven in the reverse direction, a compression element, between connecting plate 58 and gear 52 creates torque on the connecting plate 58 to swing the connecting plate 58 and lower gear/roller 52 toward gear/roller 54, as shown in FIG. 6. Once the gear/roller 52 makes contact with gear/roller 54, the swing motion stops and the gears/roller 52 begins to rotate. This rotational motion is transferred to the camshaft 13, which rotates the camshaft 13 to achieve all the results discussed in this disclosure with respect to camshaft rotation. When the belt 6 returns to the forward rotation, the reverse tension which caused the lower gear/roller 52 to swing stops and the gear/roller 52 returns to the position shown in FIG. 5 from the effect of the compression element. A stop can be used to limit the return movement of the gear/roller 52.

Figure 3:
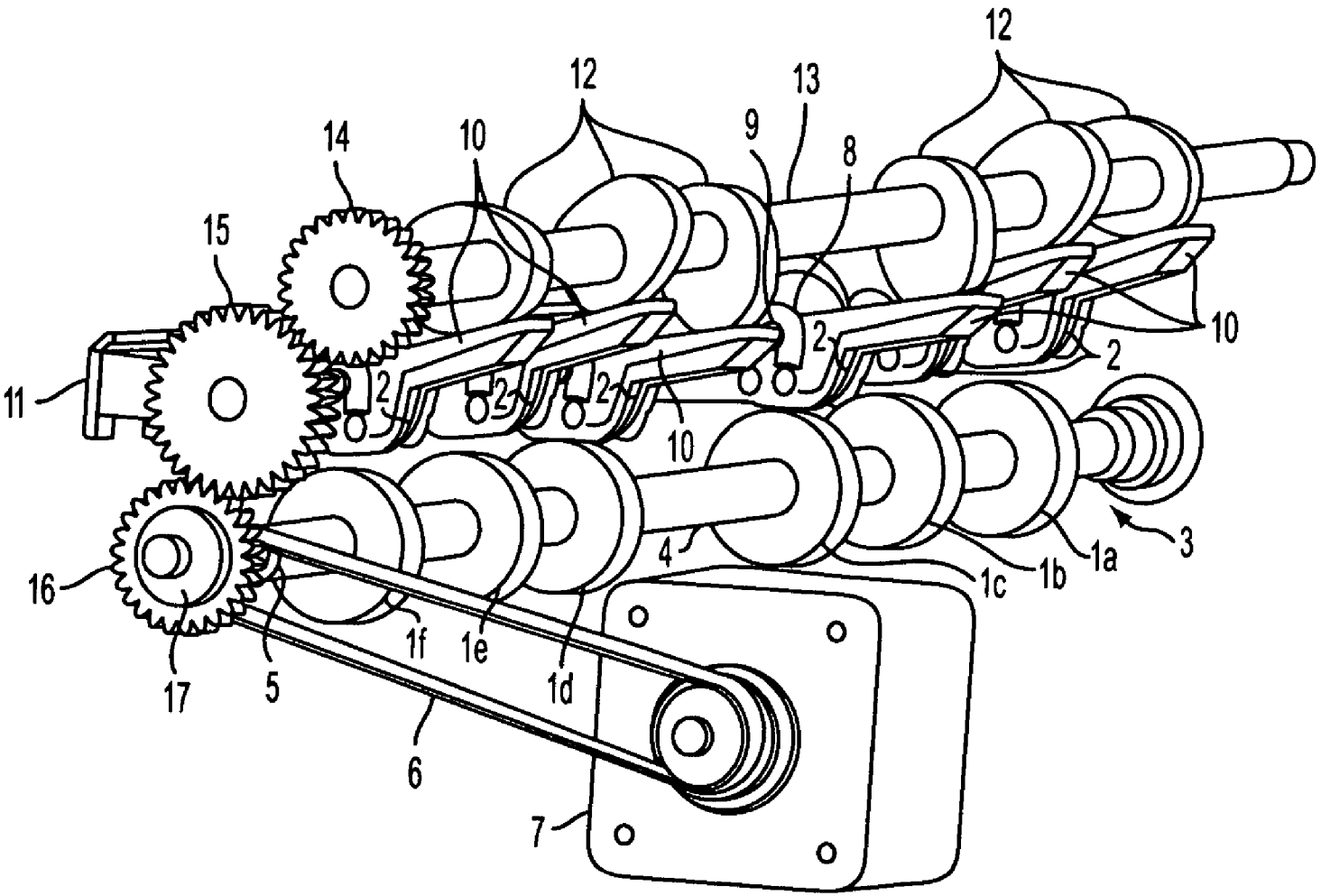
FIG. 3 is a schematic representation of a drive nip assembly according to embodiments herein.

One feature of the embodiments herein is that only one motor is required to both drive the nip in the forward direction and control the nip release mechanism in the reverse direction, thereby eliminating at least one actuator that would otherwise be required to drive the nip release mechanism. This feature becomes useful in the case of a drive roller 1 with multiple selectable nips, as shown in FIG. 3. Drive roller assembly 3 has six individual drive rollers 1*a*-1*f*, each with corresponding idlers and nip release mechanisms. This configuration is useful for obtaining the widest possible stance for a pair of drive rollers on a known media width. In FIG. 3, only the inside pair of drive rollers 1*c*, 1*d* have their corresponding idlers loaded. This condition may be appropriate for feeding narrow media, such as envelopes. If a wider media is selected for feeding, the drive motor can select one of the other nip pairs for loading by rotating in reverse while no media is present. Without the invention, either a separate motor to drive a similar camshaft or many solenoids to individually load or unload each idler assembly would be required.

The embodiments herein can also be used with a co-axial pair of drive rollers, such as may be used in de-skew or registration mechanism, as shown in FIG. 4. Two drive roller assembles 3*a*, 3*b* are driven independently by two belts 6*a*, 6*b* and two motors 7*a*, 7*b*. These drive roller assemblies are driven differentially in order to turn or steer the media. The steering action is used to achieve proper media registration (as described in U.S. Pat. Nos. 5,678,159, 4,971,304, 4,438,917, 5,169,140, 5,278,624 the complete disclosures of which are incorporated fully herein by reference). In order to properly steer the media, only one drive roller from each drive roller assembly 3 may be loaded against the media as controlled by operation of the clutch and reverse movement of the corresponding drive shaft. In this type of registration system, the widest possible stance on the media is achieved using this embodiments herein as described above. These requirements make the embodiments herein particularly applicable to this type of registration system. Before the embodiments herein, a separate motor was used to drive the camshaft assembly, adding expense and complexity.

Thus, as shown in detail above, embodiments herein comprise a printing apparatus (e.g., electrostatographic and/or xerographic machine and/or process), a module installable in a printing apparatus, etc., that have one or more media drive nips. The drive nips each comprise a pair of opposing rollers biased against one another. The rollers comprise drive rollers 1 and corresponding idler rollers 2 opposite the drive rollers 1. The drive roller 1 is driven by the motor 7 and the idler roller 2 is biased against the drive roller 1 and freely rotates with the drive roller 1 to cause a piece of media (paper, transparencies, cardstock, etc.) to be moved through the drive nip. The drive axle 4 is operatively connected to the drive rollers 1. The drive axle 4 rotates in the forward direction when moving media through the media drive nip.

In addition, one or more cams 12 are operatively connected to corresponding ones of the idler rollers 2 by way of movable supports 10. The movable supports 10 transfer movement of the cams 12 to the idler rollers 2. As the cams 12 rotate, the cams 12 move the idler rollers 2 between a first position biased against the drive rollers 1 and a second position out of contact with the drive rollers 1. In one embodiment, the cams 12 are shaped and positioned to move pairs of the idler rollers 2 independently as the cams 12 rotate to accommodate different media widths. Thus, for example, in embodiments herein, one set of cams 12 could cause only the outer pair of idler rollers 2 to be biased against their corresponding drive rollers 1 for wide media, while another set of cams 12 could cause just an inner pair of idler rollers 2 to be biased against their corresponding drive rollers 1 to accommodate a narrower piece of media.

The clutch 17 is operatively connected to the drive axle 4. In embodiments herein the camshaft 13 is operatively connected to the cams 12, and the camshaft 13 is operatively connected to the clutch 17 (for example by gears and/or belts connecting the clutch 17 to the camshaft 13). One feature of embodiments herein is that the camshaft 13 (and consequently the cams 12 themselves) is rotated by the clutch 17 only when the drive axle 4 rotates in the reverse direction opposite the forward direction. Thus, the forward movement of the drive axle 4 moves media through the drive nips and reverse movement of the drive axle 4 rotates the cams 12, thereby controlling the position of the idler rollers 2. Therefore, with embodiments herein, the movement of the cams 12 (and the associated release of the drive nip) can be easily controlled by simple reverse movement of the drive axle 4, as opposed to having to include a separate drive motor for the camshaft 13 or individual actuators or other similar devices for the idler rollers 2.

Thus, for applications that only drive the nip in a single forward direction, the nip release mechanism may be driven using the reverse motion of the nip drive. This strategy allows the drive nip idler(s) to be changed from the released state to the engaged state (or vice versa) any time the nip drive would otherwise be inactive (no media present in nip). The one-way roller clutch 17 or a swing arm apparatus is utilized in order drive the nip release mechanism during nip drive motor reverse operation. During forward drive motor operation, the roller clutch 17 or swing arm prevents the nip release mechanism from being driven, such that normal nip drive is achieved without disturbing the state of the nip release mechanism.

While the foregoing embodiments present a limited number of specific structures, such structures are only examples used to illustrate the embodiments herein, and the embodiments herein are not limited to these specific examples. For example, while gears 14-16 are illustrated as providing a connection between the drive shaft 4 and the cams shaft 13, one ordinarily skilled in the art would understand that a belt and pulley system or other substitute structure could be used in place of the gears 14-16. Similarly, while the pivoting idler sled 10 and springs are utilized to provide a biased connection between the cam 12 and the idle roller 2, one ordinarily skilled in the art would understand that many other types of biasing structures, including an elastic sled, biasing bands or straps, etc. can be used in place of the structures illustrated in the drawings accompanying this disclosure. All such substitutes are intended to be included within the structure described herein.

Further, while the structures shown in the accompanying drawings have specific shapes, one ordinarily skilled in the art would understand that the drawings are merely schematic, are not necessarily drawn to scale, and that the shapes chosen therein are selected merely as examples. Therefore, this disclosure is intended to include differently shaped devices than those shown in the accompanying drawings. For example, the cams 12 can be shaped according to any designers requirements so as to cause the idler rollers 2 to move as the designer intends. Thus, embodiments herein are intended to include all structures that utilize the operation of a one-way device operatively connected to a drive motor to open and close the gap between nip rollers by operation of the same drive motor that drives the drive roller. Once again, the embodiments herein reduce the number of drive motors and/or actuators that are needed by utilizing a one-way clutch to selectively engage devices that move the idler rollers, and the embodiments herein are intended to include any and all of such structures.

The word "printer" or "printing apparatus" as used herein encompasses any apparatus, such as a digital copier, bookmaking machine, facsimile machine, multi-function machine, etc. which performs a print outputting function for any purpose. All foregoing embodiments are specifically applicable to electrostatographic and/or xerographic machines and/or processes.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A printing apparatus comprising:

at least one media drive nip comprising a drive roller and an idler roller opposite said drive roller;

a drive axle operatively connected to said drive roller, wherein said drive axle is adapted to rotate in a forward direction when moving media through said media drive nip;

a drive motor operatively connected to said drive axle, wherein said drive motor is adapted to drive said drive axle in said forward direction and a reverse direction opposite said forward direction;

a cam operatively connected to said idler roller, wherein as said cam rotates, said cam moves said idler roller between a first position biased against said drive roller and a second position out of contact with said drive roller; and a single-direction device operatively connected to said drive axle and said cam, wherein said single-direction device is adapted to rotate said cam only when said drive axle rotates in said reverse direction.

2. The apparatus according to claim 1, further comprising a camshaft operatively connected to said cam, wherein said camshaft is operatively connected to said single-direction device and rotates only when said drive axle rotates in said reverse direction.

3. The apparatus according to claim 2, further comprising one of gears and belts connecting said single-direction device to said camshaft.

4. The apparatus according to claim 1, further comprising a movable support operatively connected to said idler roller, wherein said cam contacts said movable support and said movable support transfers movement of said cam to said idler roller.

5. The apparatus according to claim 1, further comprising at least one gear, belt, or direct connection from said drive axle to said drive motor, wherein said drive axle is directly driven by said at least one gear, belt, or direct connection to said drive motor.

6. The apparatus according to claim 1, wherein rotation of said cam moves a plurality of idler rollers above said drive roller.

7. A media drive nip module installable in a printing apparatus, said module comprising:

at least one media drive nip comprising a drive roller and an idler roller opposite said drive roller;

a drive axle operatively connected to said drive roller, wherein said drive axle is adapted to rotate in a forward direction when moving media through said media drive nip;

a drive motor operatively connected to said drive axle, wherein said drive motor is adapted to drive said drive axle in said forward direction and a reverse direction opposite said forward direction;

a cam operatively connected to said idler roller, wherein as said cam rotates, said cam moves said idler roller between a first position biased against said drive roller and a second position out of contact with said drive roller; and a single-direction device operatively connected to said drive axle and said cam, wherein said single-direction device is adapted to rotate said cam only when said drive axle rotates in said reverse direction.

8. The module according to claim 7, further comprising a camshaft operatively connected to said cam, wherein said camshaft is operatively connected to said single-direction device and rotates only when said drive axle rotates in said reverse direction.

9. The module according to claim 8, further comprising one of gears and belts connecting said single-direction device to said camshaft.

10. The module according to claim 7, further comprising a movable support operatively connected to said idler roller, wherein said cam contacts said movable support and said movable support transfers movement of said cam to said idler roller.

11. The module according to claim 7, further comprising at least one gear, belt, or direct connection from said drive axle to said drive motor, wherein said drive axle is directly driven by said at least one gear, belt, or direct connection to said drive motor.

12. The module according to claim 7, wherein rotation of said cam moves a plurality of idler rollers above said drive roller.

13. A printing apparatus comprising:

at least one media drive nip comprising a drive roller and an idler roller opposite said drive roller;

a drive axle directly connected to said drive roller, wherein said drive axle is adapted to rotate in a forward direction when moving media through said media drive nip;

a drive motor having a drive output directly connected to said drive axle, wherein said drive motor is adapted to drive said drive axle in said forward direction and a reverse direction opposite said forward direction;

a cam operatively connected to said idler roller, wherein as said cam rotates, said cam moves said idler roller between a first position biased against said drive roller and a second position out of contact with said drive roller; and a single-direction device operatively connected to said drive axle and said cam, wherein said single-direction device is adapted to rotate said cam only when said drive axle rotates in said reverse direction.

14. The apparatus according to claim 13, further comprising a camshaft operatively connected to said cam, wherein said camshaft is operatively connected to said single-direction device and rotates only when said drive axle rotates in said reverse direction.

15. The apparatus according to claim 14, further comprising one of gears and belts connecting said single-direction device to said camshaft.

16. The apparatus according to claim 13, further comprising a movable support operatively connected to said idler roller, wherein said cam contacts said movable support and said movable support transfers movement of said cam to said idler roller.

17. The apparatus according to claim 13, wherein rotation of said cam moves a plurality of idler rollers above said drive roller.

* * * * *